US008402864B1

(12) United States Patent
Stephens

(10) Patent No.: US 8,402,864 B1
(45) Date of Patent: Mar. 26, 2013

(54) WRENCH GRIPPING ASSIST APPARATUS

(76) Inventor: Joshua Stephens, Kokoma, IN (US)

( * ) Notice: Subject to any disclaimer, the term of this patent is extended or adjusted under 35 U.S.C. 154(b) by 341 days.

(21) Appl. No.: 12/731,759

(22) Filed: Mar. 25, 2010

(51) Int. Cl.
*B25B 23/16* (2006.01)
*B25B 23/18* (2006.01)

(52) U.S. Cl. ..... 81/177.2

(58) Field of Classification Search ..... 81/177.2, 81/177.1, 177.3, 177.85, 184, 125, 125.1; 362/119, 120
See application file for complete search history.

(56) References Cited

U.S. PATENT DOCUMENTS

| | | | | |
|---|---|---|---|---|
| 3,185,001 | A | 5/1965 | Viator | |
| 4,283,757 | A | 8/1981 | Nalbandian et al. | |
| 4,324,158 | A | 4/1982 | Le Roy | |
| 4,327,611 | A * | 5/1982 | Catanese et al. | 81/177.9 |
| 4,811,637 | A | 3/1989 | McCleary | |
| 4,890,355 | A * | 1/1990 | Schulten | 16/421 |
| D328,017 | S | 7/1992 | Boeke et al. | |
| 5,442,982 | A * | 8/1995 | Bell | 81/490 |
| 5,615,920 | A | 4/1997 | O'Kane et al. | |
| 5,823,077 | A * | 10/1998 | Macor | 81/177.1 |
| 5,845,986 | A | 12/1998 | Breen | |
| 6,212,979 | B1 * | 4/2001 | Wang | 81/427.5 |
| D468,617 | S | 1/2003 | Wang | |
| D485,144 | S | 1/2004 | Levine et al. | |
| D533,038 | S | 12/2006 | Hsu | |
| 7,278,751 | B2 * | 10/2007 | Chang et al. | 362/120 |

* cited by examiner

*Primary Examiner* — Hadi Shakeri

(57) ABSTRACT

A wrench gripping assist apparatus includes an elongated member having a first end, a second end and a peripheral surface extending between the first and second ends. The elongated member has a slot therein extending into the peripheral surface and through each of the first and second ends. The slot is configured to receive a handle of a wrench so that opposite heads of the wrench extend away from the first and second ends. The peripheral surface has a plurality of finger grips therein.

7 Claims, 2 Drawing Sheets

WRENCH GRIPPING ASSIST APPARATUS

BACKGROUND OF THE DISCLOSURE

Field of the Disclosure

The disclosure relates to wrench gripping devices and more particularly pertains to a new wrench gripping device for assisting a person gripping a handle of a wrench.

SUMMARY OF THE DISCLOSURE

An embodiment of the disclosure meets the needs presented above by generally comprising an elongated member having a first end, a second end and a peripheral surface extending between the first and second ends. The elongated member has a slot therein extending into the peripheral surface and through each of the first and second ends. The slot is configured to receive a handle of a wrench so that opposite heads of the wrench extend away from the first and second ends. The peripheral surface has a plurality of finger grips therein.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
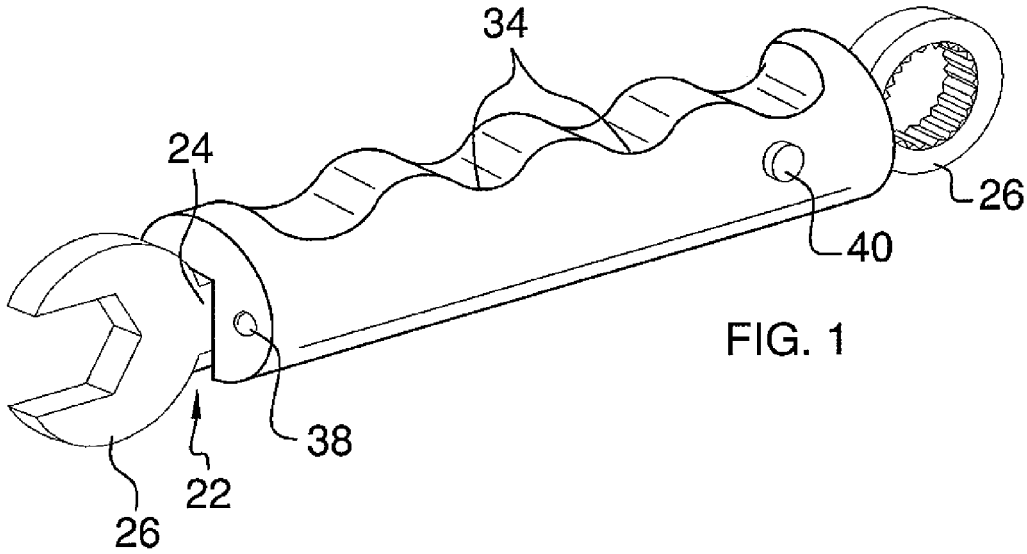
FIG. 1 is a top perspective in-use view of a wrench gripping assist apparatus according to an embodiment of the disclosure.

With reference now to the drawings, and in particular to FIGS. 1 through 6 thereof, a new wrench gripping device embodying the principles and concepts of an embodiment of the disclosure and generally designated by the reference numeral 10 will be described.

As best illustrated in FIGS. 1 through 6, the wrench gripping assist apparatus 10 generally comprises an elongated member 12 that has a first end 14, a second end 16 and a peripheral surface 18 extending between the first 14 and second 16 ends. The elongated member 12 has a slot 20 therein. The slot 20 extends into the peripheral surface 18 and through each of the first 14 and second ends 16. The slot 20 is configured to receive a handle 24 of a wrench 22 so that opposite heads 26 of the wrench 22 extend away from the first 14 and second 16 ends as shown in FIG. 1.

The slot 20 is defined by a pair of lateral walls 28 intersecting the peripheral surface 18 and a base wall 30. The lateral walls 28 are configured to frictionally engage the wrench 22. A longitudinal axis of the elongated member 12 extending through the first 14 and second 16 ends is positioned between the base wall 30 and a juncture 32 of the peripheral surface 18 and the lateral walls 28. The elongated member 12 is comprised of a resiliently compressible material such as an elastomeric material or a plastic material.

The peripheral surface 18 has a plurality of finger grips 34 therein that are aligned with each other along a line from the first end 14 to the second 16 end. The finger grips 34 are positioned opposite of the slot 20. The grips 34 are formed by concavely arcuate indents in the peripheral surface.

Figure 2:
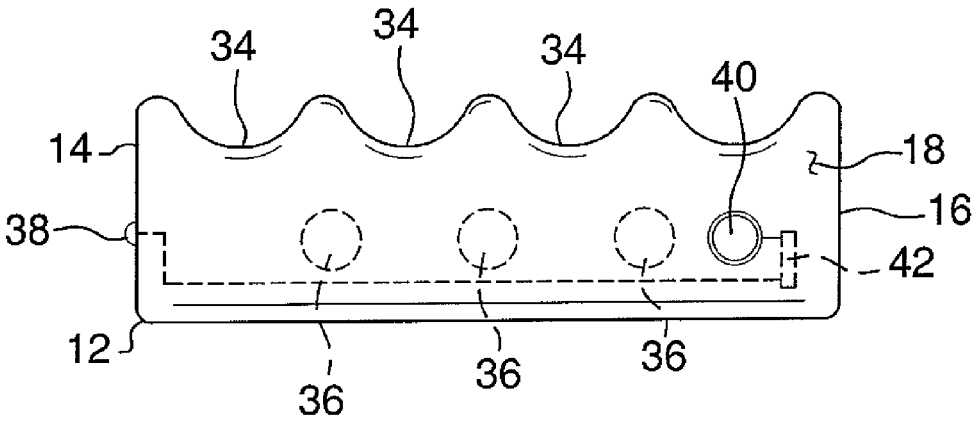
FIG. 2 is a side view of an embodiment of the disclosure.
Figure 3:
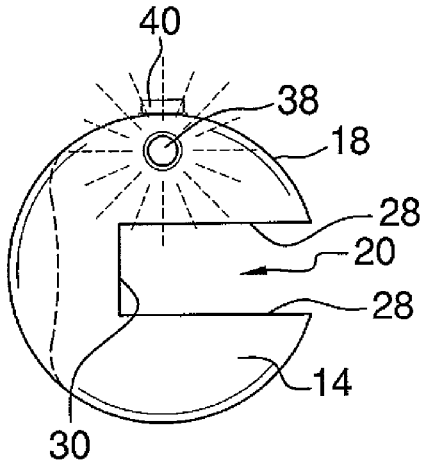
FIG. 3 is a front view of an embodiment of the disclosure.
Figure 4:
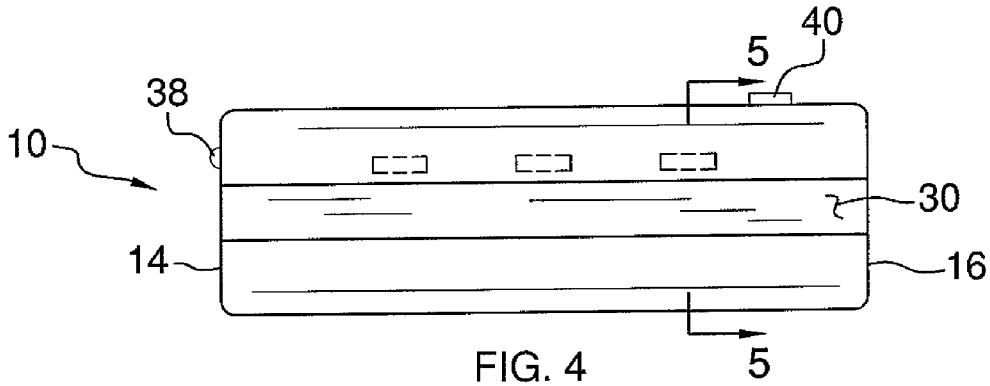
FIG. 4 is a top view of an embodiment of the disclosure.
Figure 5:
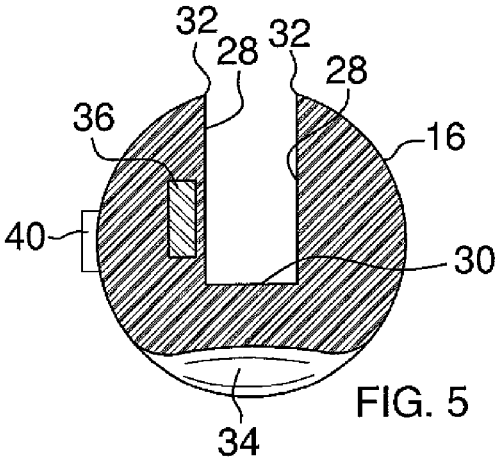
FIG. 5 is a cross-sectional view of an embodiment of the disclosure.
Figure 6:
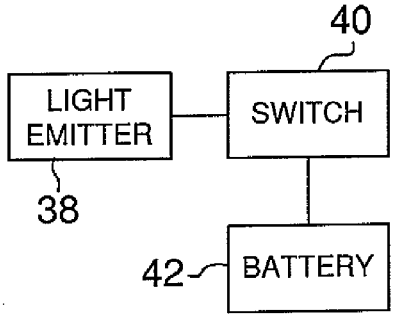
FIG. 6 is a schematic view of an embodiment of the disclosure.

At least one magnet 36 is mounted in the elongated member 12. The at least one magnet 36 is configured to be magnetically attracted to the wrench 22 when the wrench 22 is positioned in the slot 20 to facilitate retention of the wrench 22 in the slot 20. As shown in FIG. 2, multiple magnets 36 may be mounted within the elongated member 12 adjacent to the slot 20.

A light emitter 38 is mounted on the elongated member 12. An actuator 40 to turn the light emitter 38 on or off is electrically coupled to the light emitter 38 and is mounted on the elongated member 12. The light emitter 38 is positioned on the first end of the elongated member 12. The light emitter 38 may comprise a light emitting diode and be powered by a battery 42 mounted in the elongated member 12.

In use, the wrench 22 is positioned within the slot 20 as shown in FIG. 1 to provide for additional girth to the handle 24 of the wrench 22 while it is being used. This, coupled with the resiliently compressible material of the elongated member 12 will provide for a more comfortable grip while a person is using the wrench 22. The light emitter 38 will provide light as needed adjacent to one of the heads 26 of the wrench 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A wrench gripping assist apparatus comprising:

an elongated member having a first end, a second end and a peripheral surface extending between said first and second ends, said elongated member having a slot therein, said slot extending into said peripheral surface and through each of said first and second ends, said slot being configured to receive a handle of a wrench such that opposite heads of said wrench extend away from said first and second ends;

said slot being defined by a pair of lateral walls intersecting said peripheral surface and a base wall, said lateral walls being configured to frictionally engage the wrench; said peripheral surface having a plurality of finger grips therein; and a plurality of magnets being mounted in said elongated member, each said magnet being configured to be magnetically attracted to the wrench when the wrench is positioned in said slot to retain the wrench in said slot, said magnets being aligned and extending along one of said lateral walls.

2. The apparatus according to claim 1, wherein a longitudinal axis of said elongated member extending through said first and second ends is positioned between said base wall and a juncture of said peripheral surface and said lateral walls.

3. The apparatus according to claim 1, wherein said finger grips are aligned with each other along a line from said first end to said second end, said finger grips being positioned opposite of said slot.

4. The apparatus according to claim 1, wherein said elongated member is comprised of a resiliently compressible material.

5. The apparatus according to claim 1, further including a light emitter being mounted on said elongated member, an actuator to turn said light emitter on or off being electrically coupled to said light emitter and being mounted on said elongated member.

6. The apparatus according to claim 5, wherein said light emitter is positioned on said first end of said elongated member.

7. A wrench gripping assist apparatus comprising:

an elongated member having a first end, a second end and a peripheral surface extending between said first and second ends, said elongated member having a slot therein, said slot extending into said peripheral surface and through each of said first and second ends, said slot being configured to receive a handle of a wrench such that opposite heads of said wrench extend away from said first and second ends, said slot being defined by a pair of lateral walls intersecting said peripheral surface and a base wall, said lateral walls being configured to frictionally engage the wrench, a longitudinal axis of said elongated member extending through said first and second ends being positioned between said base wall and a juncture of said peripheral surface and said lateral walls;

said peripheral surface having a plurality of finger grips therein, said finger grips being aligned with each other along a line from said first end to said second end, said finger grips being positioned opposite of said slot;

said elongated member being comprised of a resiliently compressible material;

a plurality of magnets being mounted and embedded in said elongated member, each said magnet being configured to be magnetically attracted to the wrench when the wrench is positioned in said slot to retain the wrench in said slot, said magnets being aligned and extending along one of said lateral walls: and a light emitter being mounted on said elongated member, an actuator to turn said light emitter on or off being electrically coupled to said light emitter and being mounted on said elongated member, said light emitter being positioned on said first end of said elongated member.

* * * * *